US008640417B2

(12) United States Patent
Tilton

(10) Patent No.: US 8,640,417 B2
(45) Date of Patent: Feb. 4, 2014

(54) CUSTOM COFFERED SURFACE LAYOUT, FABRICATION, AND INSTALLATION METHODS AND PROCESSES

(76) Inventor: Jason Tilton, Oyster Bay, NY (US)

( * ) Notice: Subject to any disclaimer, the term of this patent is extended or adjusted under 35 U.S.C. 154(b) by 30 days.

(21) Appl. No.: 13/269,929

(22) Filed: Oct. 10, 2011

(65) Prior Publication Data

US 2013/0086863 A1 Apr. 11, 2013

(51) Int. Cl.
*E04B 9/00* (2006.01)

(52) U.S. Cl.
USPC ..... 52/506.06; 52/287.1; 52/284

(58) Field of Classification Search
USPC ..... 52/287.1, 288.1, 270, 272, 284, 506.06, 52/506.09, 506.1, 311.2
See application file for complete search history.

(56) References Cited

U.S. PATENT DOCUMENTS 450,274 A * 4/1891 Wilson ..... 52/461
985,367 A * 2/1911 Pitney ..... 52/313
3,828,506 A * 8/1974 Phillips ..... 52/506.07
4,189,888 A * 2/1980 Blitzer, Jr. ..... 52/506.07
4,452,021 A * 6/1984 Anderson ..... 52/506.07
4,722,161 A * 2/1988 Young ..... 52/506.07
4,736,559 A * 4/1988 Young ..... 52/313
4,926,606 A * 5/1990 Hanson ..... 52/506.07
5,433,048 A * 7/1995 Strasser ..... 52/288.1
5,884,444 A * 3/1999 Harris ..... 52/311.2
7,017,317 B2 * 3/2006 Capozzo ..... 52/506.07
8,028,481 B2 * 10/2011 Deschenes ..... 52/311.2
2010/0058692 A1 * 3/2010 Deschenes ..... 52/311.2

FOREIGN PATENT DOCUMENTS

JP 01125447 A * 5/1989 ..... E04B 5/52

* cited by examiner

*Primary Examiner* — Brent W Herring
(74) *Attorney, Agent, or Firm* — Tran & Associates

(57) ABSTRACT

Systems and methods are disclosed for providing coffered ceilings with a plurality of preassembled coffered modules, each of which includes a ceiling panel precut in accordance with an order; cutting beam wall boards in accordance with the order, wherein the beam wall boards are attached to the ceiling panel and extend away from the ceiling panel; and a beam wall molding custom-fitted inside the beam wall boards. Automated systems to receive and fabricate custom coffered module orders upon payment are also disclosed.

15 Claims, 9 Drawing Sheets

CUSTOM COFFERED SURFACE LAYOUT, FABRICATION, AND INSTALLATION METHODS AND PROCESSES

BACKGROUND OF THE INVENTION

The present invention relates generally to a custom fitted and permanently applied decorative coffered surface built by using typical molding and millwork materials.

DESCRIPTION OF RELATED ART

The intersecting grid of structural beams that made up the very first coffered ceilings was designed to help support heavy roof loads, but they also added to the ceiling's architectural and visual appeal. Today's coffered ceilings are primarily installed as an aesthetic element and use a grid of intersecting, non-structural, typically hollow, box beams to replicate the desirable look and feel of their structural predecessors. The main purpose of the modern day coffered ceiling is to add decoration and appeal to an otherwise plain and unappealing surface. Likewise, a coffered detail of intersecting beams may also be applied to walls or any other form of horizontal, vertical, angled, straight or curved surfaces for the purpose of decoration and aesthetic enhancement.

One type of system that is used to mimic or resemble the look of a true coffered ceiling is to use a suspended ceiling grid and ceiling tile type application. These applications use standard sized, typically 2'×2' or 2'×4', removable tiles that rest on a suspended grid system of either standard or custom type T-bars, L-channels, tracks, and so on, which are hung from the substrate with suspension wires, screw hooks, etc. To achieve the appearance of a coffered ceiling the individual tiles are made with a deep recess to resemble coffers, but since these ceiling systems do not utilize any form of actual beams they are not considered to be true coffered ceilings and should not be confused with the real thing. They simply create a facade.

A typical decorative coffered ceiling constructed with hollow "box beams" can also offer a useful means for routing and/or hiding existing and/or new mechanical and/or structural items such as electrical wires, plumbing pipes, duct work, support headers etc. which can be routed inside of or covered over by the hollow box beams which are typically constructed to have only 3 sides.

Coffered ceilings have also been known to improve a room's acoustical performance and are often used for this purpose in theatres or in media rooms where sound quality is critical and aesthetic enhancements are desired.

The conventional methods for layout, fabrication and installation of a permanently installed decorative coffered ceiling include the use of raw molding and millwork materials that are custom fabricated, cut, assembled and fastened to the substrate by an onsite team of craftsmen and/or carpenters to achieve a proper fit and finish. These conventional, onsite custom fabrication methods have the following drawbacks:

1. All work must be performed under existing site conditions which significantly diminishes the quality of the custom fabrication.
2. They require a large onsite work space which often crowds and/or interferes with either the other tradesman/laborers, families, employees, customers and so on who may be working, living or conducting business at or on the same site. All of which may cause delays.
3. They require a wide variety of professional woodworking tools and equipment which need to be set-up onsite to create the coffered ceiling. This ultimately adds to the overall time and labor required to complete the coffered ceiling installation.
4. It requires the use of nailer blocks or boards to first be fastened or adhered to the substrate to which all of the beams are secured. This initial installation step requires additional materials and labor, which ultimately adds to the overall cost. Delays may also be caused in circumstances where the nailer blocks/boards run parallel to and cannot be directly fastened to the underlying substrate framework. In these instances adhesive and hollow wall anchors must be used to secure the nailer blocks/boards and be given adequate time to dry or set before moving forward with the installation of the beams.
5. The onsite custom fabrication process creates a significant mess, for example, the high volume of cutting and milling that is required of the materials, creates a substantial amount of dust, debris and waste. This can often crowd and/or interfere with the other tradesman/laborers, families, employees, customers and so on who may be working, living or conducting business at or on the same site. All of which may cause delays.
6. The substantial amount of dust, debris and waste creates the necessity for proper containment, especially on remodeling type residential or commercial projects, and results in a more extensive cleanup process. This ultimately adds to the overall time and labor required to complete the coffered ceiling installation.
7. The substantial amount of dust, debris and waste creates a safety hazard for both the installers of the coffered ceiling as well as for the other tradesman/laborers, families, employees, customers and so on who may be working, living or conducting business at or on the same site.
8. Onsite custom fabrication requires a high level of woodworking and mathematical skill on the part of the craftsman and/or carpenters who are performing the installation. This equates to higher labor wages for the higher skillset which ultimately adds to the overall cost of the coffered ceiling.
9. Onsite fabrication inherently takes a long time to complete. Typical ceilings take an average of about five days.

Adding to the complexity of onsite fabrication and installation of a coffered ceiling, is the circumstance of significant overhead work. This overhead work is performed on either ladders or scaffolding, which makes completion of the installation inherently more dangerous, challenging, frustrating, and time consuming.

Another significant issue that the conventional onsite fabrication and installation methods for a coffered ceiling do not address is that the surface of the substrate on which the coffered ceiling is installed, typically plaster or drywall, is rarely, if ever, perfectly smooth, flat, level, straight or free of defects such as holes cracks, chips, stains and so on. These imperfections and/or conditions lead to one of several common drawbacks and/or undesirable scenarios:

1. If the initial installation of the beams is performed in a manner as to keep them tight to an un-level, uneven, crooked or wavy substrate surface, with no regard for being level, straight or flat, the beams will ultimately reflect and magnify the surface imperfections. These will reveal themselves by making it very difficult to not only properly fit and join the beams to one another, but also to fit and join any and all additional components to the beams such as the crown moldings, detail moldings, ornamentation and the like. There will be difficulty in both the independent installation of these components as well as how they relate to and meet with each other at the intersecting points, miters, copes, joints and so on. This situation will ultimately yield unacceptable quality, and/or an aesthetically unappealing finished coffered ceiling.

2. If the initial installations of the beams are somehow shimmed and/or otherwise fastened to the an un-level, crooked, wavy, or otherwise imperfect, inconsistent substrate surface in a way that manages to achieve a level, straight and/or flat plane at the bottom of the beams, the issues will then reveal themselves in the inconsistency that is created in the distance between the bottom of the beams and the substrate surface. This inconsistency causes significant issues with the subsequent beam wall moldings, detail moldings, ornamentation and the like that are installed following the installation of the beams. These issues include:
   a. If the installer chooses to keep the molding tight to the substrate surface the reveal, or distance between the bottom of the beams and the bottom of the beam wall moldings, will not remain equal or consistent. In this instance the angles of the molding in the corners where the beams intersect will become inconsistent and therefore much more difficult to complete with neat and proper joints. This adds additional time and labor to the process while yielding less than perfect results. The inconsistent reveals between the moldings and the beams will also be quite noticeable when complete and will detract from the overall appearance of the finished coffered ceiling.
   b. If the installer chooses to keep the reveal between the bottom of the moldings and the bottom of the beams equal or constant, on all of the beams, then the top of the beam wall moldings will not remain tight to the substrate surface in all areas. This will create various sized gaps between the top of the beam wall moldings and the substrate surface. The gaps will then need to be filled either with custom sized strips of wood/material, with wood filler and or caulking. This will also add time, labor and cost to the process while yielding less than perfect results.
3. The substrate surface is not always fully covered when using conventional methods and therefore imperfections, such as holes, cracks, chips, stains and so on may still show or be seen after a coffered detail has been installed. In these circumstances the exposed portions of the substrate will more than likely require further attention after the coffered detail has been installed such as patching, plaster/spackling and so on. This will ultimately add time, labor and cost to the process.

Another prior art system that has been used to create a decorative coffered ceiling is the Classic Coffered Ceiling Kit offered by Curve Makers Inc. that uses prefabricated, two-piece crown assembly boxes as described by the company. While the boxes that make up these kits may appear somewhat similar to the coffer modules of the present invention, they differ mainly due to their inability to address the ever present issues of an imperfect substrate just like the prior art. Likewise, the kit differs in its lack of customization options. The Curve Makers kit is essentially a one-style-fits-all product with the only customizable options being the length and width of the boxes.

For example, the Curve Makers kit does not include a fully integrated ceiling/surface panel. This significant omission and flaw in their design allows for the underlying substrate surface to show through the center of each crown assembly box. This design does not address the problems and/or the impact that an imperfect substrate surface has on the installation and/or the quality and aesthetic appearance of the finished product. While the crown assembly boxes of this kit maintain a constant reveal between the bottom of the beams and the bottom of the crown molding and while they can be shimmed and/or otherwise fastened to the imperfect substrate surface in a way that manages to achieve a level, straight and/or flat plane of the entire kit, the inconsistency issue still arises in the distance between the top of the boxes and/or crown molding and the substrate surface as described in the prior art previously outlined.

Additionally, the Curve Makers coffered ceiling kits only offer one type, style and depth of crown assembly boxes and they are only available in square or rectangular shapes. Furthermore, the kits are only available in solid hardwood materials which are inherently more expensive and more prone to twisting and warping than other modern woodworking material options that are available in today's market. All of these factors dramatically limit the design options and customization capabilities of the customer or end user.

The lack of viable fabrication, installation and pricing information that has been made available from Curve Makers for their ceiling kit, as well as the fact that it is not part of their primary business or product line, have frustrated potential purchasers. As of the date of this application, the kits appear to have been withdrawn from sales inquiries and removed from the company's website.

In addition, the use of the present invention may have excellent potential for use on vertical or angled walls or surfaces. Regardless of the substrate surface type, the present invention would utilize any form of woodworking materials such as solid wood, plywood, MDF, polyurethane, and so on.

A prefabricated coffered ceiling and surface system that overcomes the numerous problems associated with prior art would be valuable to this trade.

BRIEF SUMMARY OF THE INVENTION

Systems and methods are disclosed for providing coffered ceilings with a plurality of preassembled coffer modules, each of which includes a ceiling panel precut in accordance with an order; beam wall boards pre-cut in accordance with the order, wherein the beam wall boards are attached perpendicular to and extending away from the ceiling panel; and a beam wall molding cut and custom-fitted inside the beam wall boards. Automated systems to receive and fabricate custom coffered module orders upon payment are also disclosed.

In another aspect, a method to form a preassembled coffered module includes cutting a ceiling panel to a predetermined size; attaching coffer beam wall boards perpendicular to the ceiling board wherein the coffer beam wall board placement defines a predetermined size flange around the perimeter of the module for use in fastening it to the substrate as well as for proper spacing between other modules during the on-site installation process; installing beam wall moldings inside of the beam wall boards.

In another aspect, an online system and method to form a coffer module in accordance with a customer's order includes receiving the customer's order for coffered modules with a predetermined size and with options selected from a group consisting of: without preassembly and unfinished, without preassembly and prefinished, preassembled and unfinished, or preassembled and prefinished; cutting a ceiling panel to the predetermined size; fabricating coffer beam wall boards to be attached perpendicular to the ceiling panel, wherein the coffer beam wall board placement defines a predetermined size flange remaining around the perimeter of the module for use in fastening it to the substrate as well as for proper spacing between other modules during the on-site installation process; cutting beam wall moldings to be installed inside of the beam wall boards; and shipping the completed preassembled coffer modules for on-site installation or shipping of the coffer module components unassembled for on-site preassembly and installation.

Advantages of the preferred embodiments may include one or more of the following. The unique custom coffered ceiling layout, fabrication, and installation methods and processes of the present invention overcome the problems associated with prior art. The level of quality that is able to be achieved by performing the prefabrication and preassembly processes under shop conditions is far superior to what can be achieved under the less than ideal conditions typically found onsite. As a result of the superior quality of the coffers the ted quality of the painting or staining can also be expected to yield superior results. By using the present invention to prefabricate and preassemble individual coffer modules, with each module having its own integrated ceiling/surface panel, the coffered ceiling system allows for consistently level, straight, and true installations regardless of the underlying substrate conditions. No matter how un-level, uneven, crooked or imperfect the substrate surface may be, the present invention solves the problems associated with installing a coffered ceiling on such an imperfect surface. Furthermore, the coffered ceiling system significantly reduces the labor, time, materials, and equipment required to complete the installation process. It also substantially improves onsite safety conditions and cleanliness, all the while, significantly reducing the overall cost. The result is a custom fitted and permanently applied decorative coffered surface built by using typical molding and millwork materials. (i.e. wood, plywood, medium density fiberboard, polyurethane, and so on). Since the components are being prefabricated offsite, onsite safety issues are significantly reduced. It does so by providing a proprietary measurement and layout system that ensures all components are produced accurately yielding precise coffer modules and an exact fit to a given ceiling or surface area. The components are prefabricated and may be preassembled to create individual coffer modules using a unique methodology that eliminates, and/or significantly reduces the many deficiencies associated with prior art. The preferred embodiment may be installed on an imperfect surface while allowing for independent adjustment of the individual coffer modules and therefore providing the ability to achieve a perfectly level, straight and/or flat plane across the coffered ceiling system. The prefabrication and preassembly methods and processes of present invention allow it to be installed in 25% of the time of a conventional custom onsite installation. In renovation projects the shorter installation time equates to a reduction in disturbance to the homeowner and in commercial applications it equates to a reduction in down time and the resulting loss of business and/or functionality of the space.

The unique methods and processes for assembly of the preferred embodiment are ideal for and befitting of an online business model as they allow for outsourcing of the manufacturing and/or installation methods and processes. Orders that are received by the authorized sales/marketing entity can be routed to a remote production facility for fabrication, assembly and shipment of the order to the customer. The installation of the finished product can then be scheduled with an authorized installer or completed by the customer themselves.

The information received in a purchase order, along with the site measurements, are first deciphered and confirmed with the customer prior to being converted into a production order. Once converted into a production order it is then routed to an authorized, outsourced manufacturing shop or facility with the required knowledge and equipment to fabricate, assemble and ship the finished product to the customer. The business model of outsourcing the manufacturing and production of the product relieves the authorized sales/marketing entity of the large initial setup costs associated with the establishment and ownership of a dedicated manufacturing facility as well as the expense and burden of the daily operation and the employees needed for such.

By outsourcing the manufacturing methods and processes the unique business model of the preferred embodiment also serves to help pre-existing facilities, which are authorized to manufacture the preferred embodiment, to increase their annual revenues with the additional sales from the production orders they receive. This forms a natural expansion for any shop or facility that has the proper knowledge and equipment to manufacture the preferred embodiment as required. Likewise, the unique process for installation may also be outsourced to pre-authorized installers in various regions and/or territories or simply performed by the customer themself. This again relieves the expense and burden of employees and is befitting of an online business model.

Additional benefits to the preferred embodiment include, but are not limited to, the ability to manufacture the coffer modules in a multitude of sizes, depths and shapes, for example, square, rectangular, triangular, octagonal, hexagonal, and even circular and various forms of oval and elliptical shapes. It provides the ability to utilize lower skilled and lower wage labor to install. It is fully customizable to fit virtually any ceiling/surface area perfectly and the short lead time to manufacture offers a tremendous benefit to customers under any circumstance. Since it may utilize commonly sized and readily available and/or stock woodworking materials, it is easier for an authorized manufacturing facility to control costs and to maintain short production lead times. The present invention also has the ability to be prefinished in a wide variety of paint and/or stain finishes prior to shipment and/or installation reducing the time to finish it on-site after it has been installed. It also eliminates the need to fully finish the underlying substrate surface on which it will be installed thus saving the time, money and mess associated with such.

Other advantages of the preferred embodiment may include one or more of the following:

1) A substantial increase in overall quality and finish vs. conventional coffered ceiling installations.
2) A substantial decrease in the time required to complete the design, fabrication and installation.
3) A substantial decrease in the skill set and/or skill level required to complete the installation properly and with professional results.
4) A substantial increase in the safety of the installers and those working around them or on the same site.
5) A written installation process, with supporting photos and/or illustrations, that is consistent for all applications.
6) A substantial reduction in the amount of professional tools and equipment required to complete the installation.
7) Elimination of the need to measure, mark and layout the entire beam pattern on the substrate surface prior to starting the installation process.
8) The unique method requiring only two measurements in preparation for installation, which include a) the center of the length of the surface area, and; b) the center of the width of the surface area.
9) A substantial reduction in the amount of on-site fabrication and fastening required.
10) A substantial reduction in the mess and dust caused and/or created by the on-site fabrication (cutting and milling).

11) A substantial reduction in the disturbance caused to the customer in renovation and/or enhancement type projects.
12) An integrated ceiling panel that achieves complete coverage of the substrate surface hiding imperfections that may exist
13) Various design options for the integrated ceiling/surface panel including, but not limited to: a) plain smooth; b) applied molding; c) flat/recessed panel; d) raised panel, and; e) bead board panel.
14) A method of easy adjustment for level and/or straight bottom surface by using shims.
15) The ability to be laid out and custom sized to fit virtually any surface area perfectly whether square, rectangular, hexagonal, octagonal or irregular in shape.
16) The ability to be manufactured in various common and/or exotic woodworking materials to suit the end user.
17) The ability to be prefinished in various paint or stain colors prior to being shipped and/or installed.

The disclosure provided in this application illustrates the preferred embodiments and broadly state the methodologies that may be used in order to manufacture and install a permanently affixed, fully customizable coffered ceiling system of superior quality in a fraction of the time vs. conventional custom onsite methods.

DETAILED DESCRIPTION OF THE INVENTION

A. Description of the Preferred Embodiment

Figure 1:
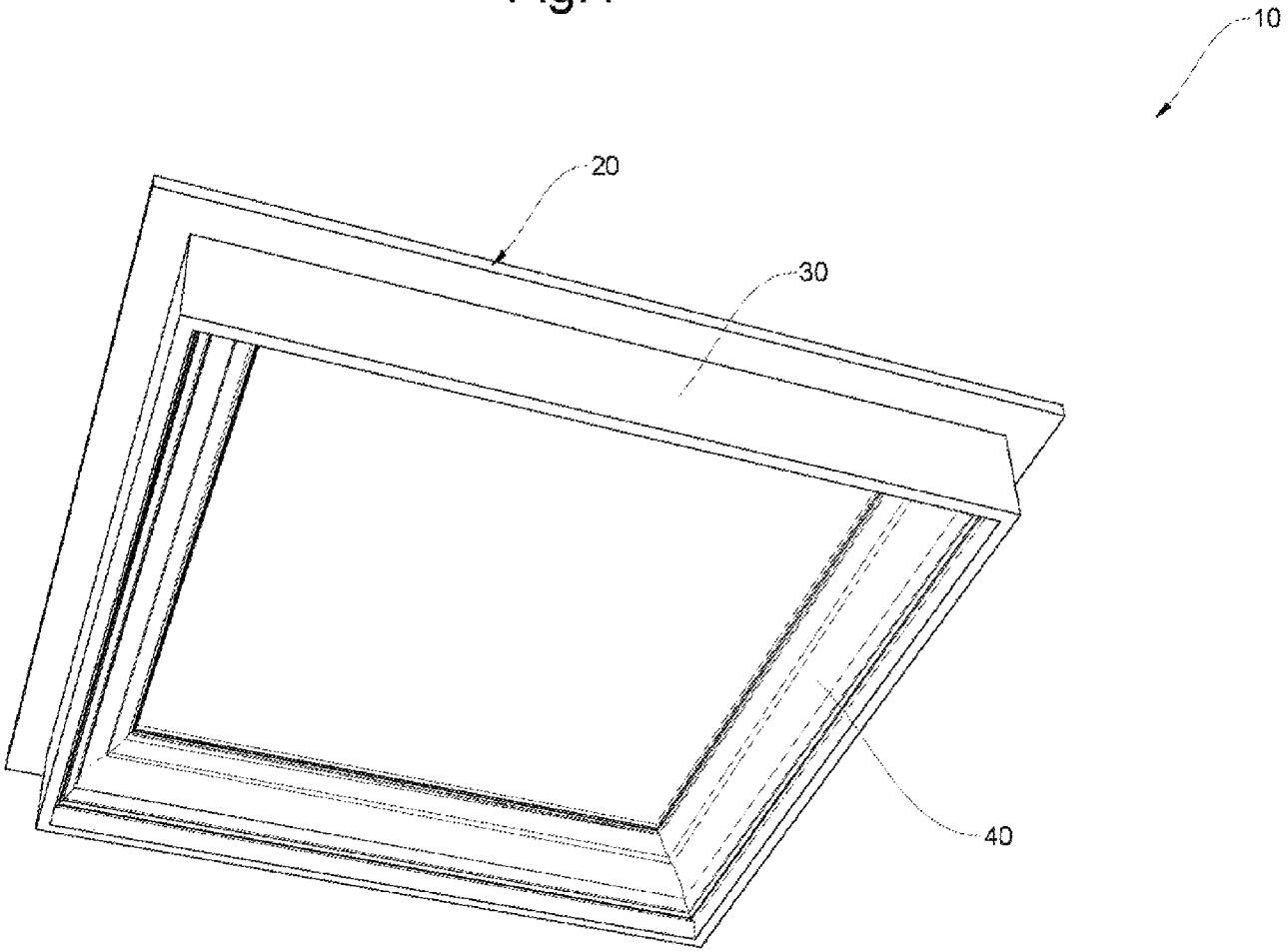
FIG. 1 is a perspective view of the preferred embodiment illustrating a single coffer module.
Figure 2:
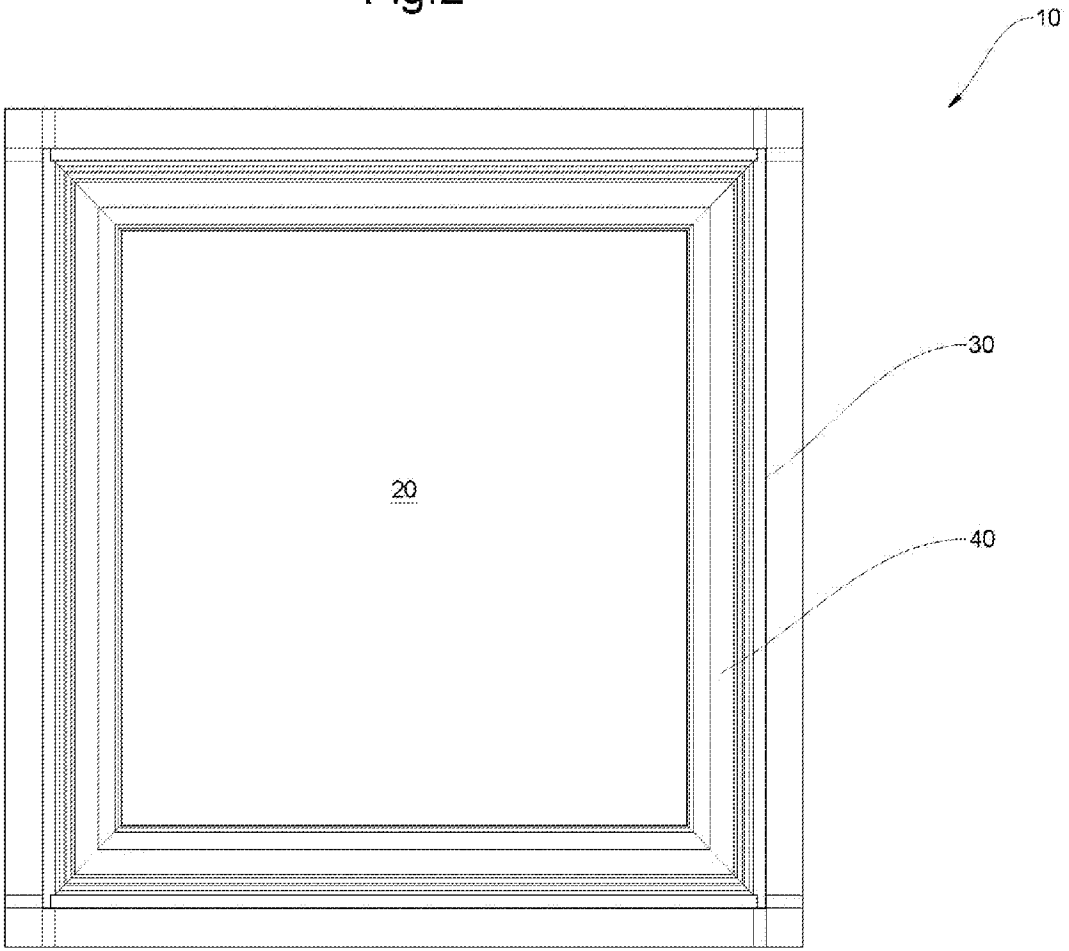
FIG. 2 is a plan view of the preferred embodiment illustrating a single coffer module.
Figure 3:
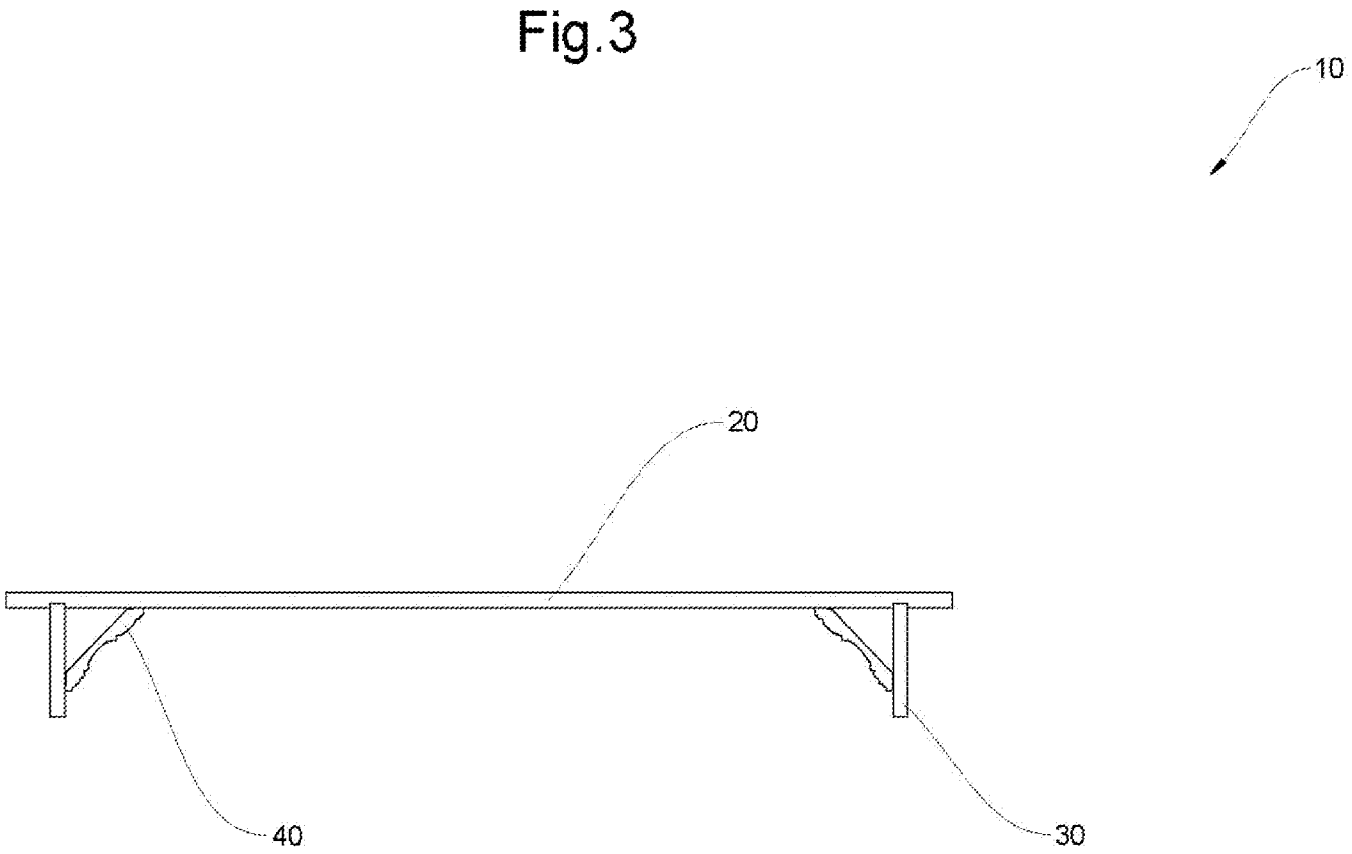
FIG. 3 is a cross-sectional view of the preferred embodiment illustrating a single coffer module.

The following discusses the methods and processes involved in the layout, design, fabrication, manufacturing, and installation of prefabricated and/or preassembled coffered modules that make up an entire coffered ceiling or surface. In FIGS. 1, 2 and 3, the single coffer module of the preferred embodiment 10 consists of a ceiling/surface panel 20, a beam wall board 30 and a beam wall molding 40. In contrast to conventional methods, the module of FIGS. 1-3 are prefabricated and may be preassembled to create individual coffer modules using a unique methodology that eliminates, and/or significantly reduces the many deficiencies associated with prior art. The preferred embodiment may be installed on an imperfect surface while achieving complete coverage of the substrate and allowing for independent adjustment of the individual coffer modules and therefore providing the ability to achieve a perfectly level, straight and/or flat plane across the coffered ceiling system. The prefabrication and preassembly methods and processes of present invention allow it to be installed in 25% of the time of a conventional custom onsite installation. In renovation projects the shorter installation time equates to a reduction in disturbance to the homeowner and in commercial applications it equates to a reduction in down time and the resulting loss of business and/or functionality of the space.

The unique custom coffered ceiling layout, fabrication, and installation methods and processes of the present invention overcome the problems associated with prior art. The level of quality that is able to be achieved by performing the prefabrication and preassembly processes under shop conditions is far superior to what can be achieved under the less than ideal conditions typically found onsite. As a result of the superior quality of the coffers the quality of the painting or staining processes can also be expected to yield superior results. By using the present invention to prefabricate and preassemble individual coffer modules, with each module having its own integrated ceiling/surface panel, the coffered ceiling system allows for both complete coverage of the substrate as well as consistently level, straight, and true installations regardless of the underlying substrate conditions. No matter how un-level, uneven, crooked, damaged or imperfect the substrate surface may be, the present invention solves the problems associated with conventional methods of installing a coffered ceiling on such an imperfect surface. Furthermore, the coffered ceiling system significantly reduces the labor, time, materials, and equipment required to complete the installation process. It also substantially improves onsite safety conditions and cleanliness, all the while, significantly reducing the overall cost. The result is a custom fitted and permanently applied decorative coffered ceiling/surface built by using typical molding and millwork materials. (i.e. wood, plywood, medium density fiberboard, polyurethane, and so on). Since the components are being prefabricated offsite and preassembled offsite or at any point prior to being installed, onsite safety issues are significantly reduced. It does so by providing a proprietary measurement and layout system that ensures all components are produced accurately yielding precise coffer modules and an exact fit to a given ceiling or surface area.

Figure 4:
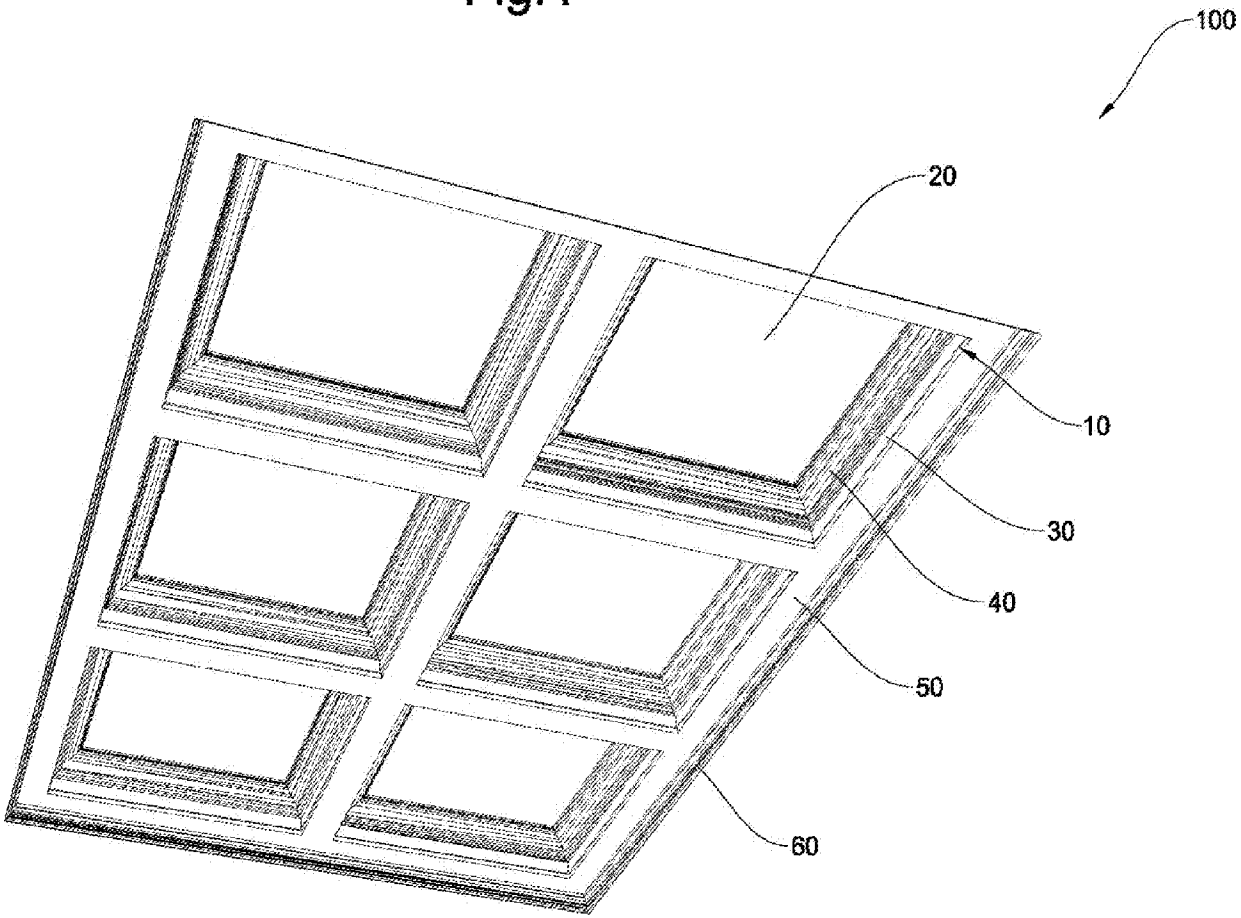
FIG. 4 is perspective view of the preferred embodiment illustrating a complete coffered ceiling system as it terminates into perpendicular walls/substrate surfaces.
Figure 5:
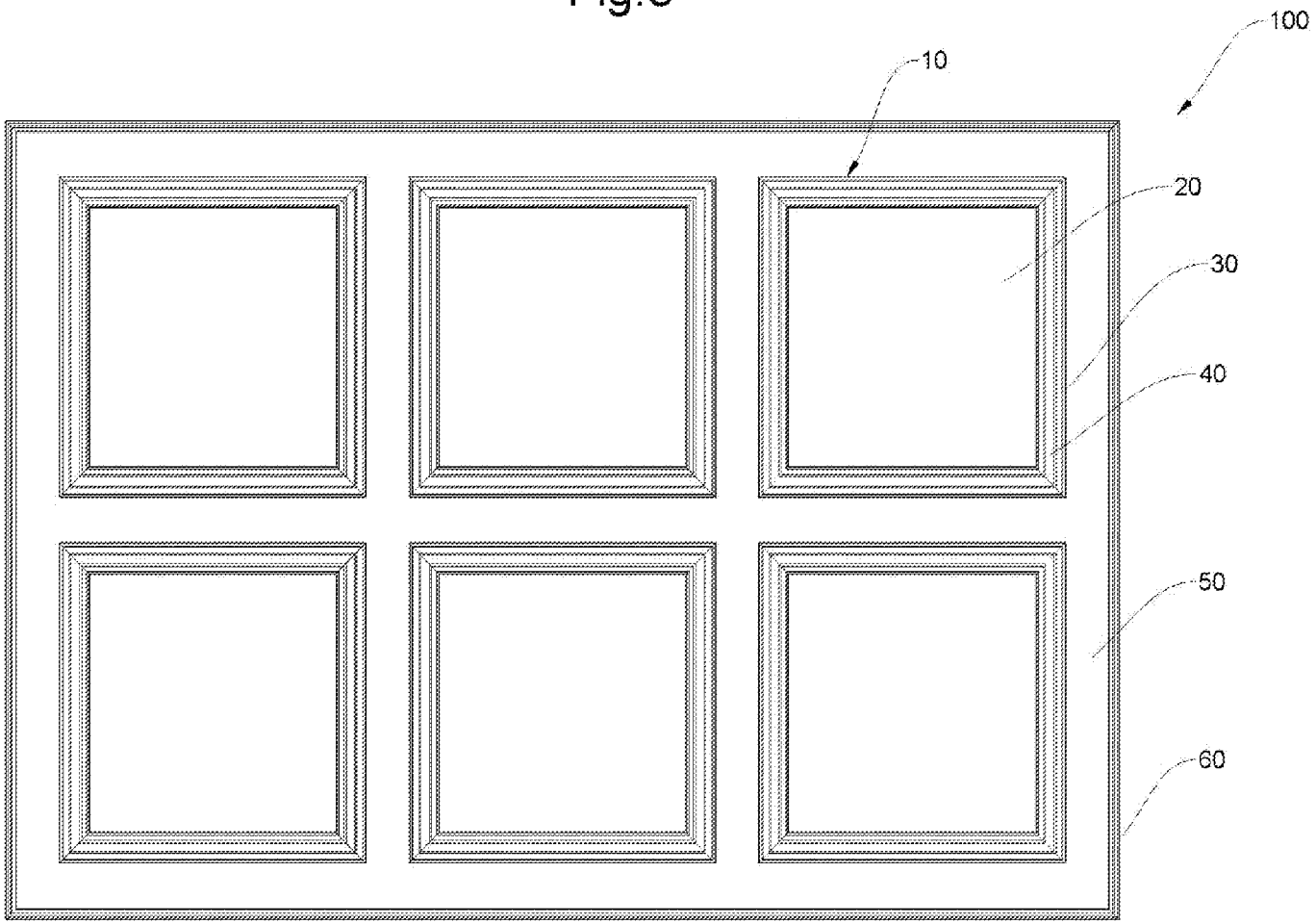
FIG. 5 is plan view of the preferred embodiment illustrating a complete coffered ceiling system as it terminates into perpendicular walls/substrate surfaces.

As illustrated in FIGS. 4 and 5, an entire coffered system of the preferred embodiment 100 consists of six modules, in which is like that of the preferred embodiment 10 in FIGS. 1, 2, and 3, and is comprised of ceiling/surface panel 20, a beam wall board 30, and a beam wall molding 40. The other five are essentially identical (not numbered). The six modules have been installed with beam bottom board 50, and perimeter molding 60 in place. While the appearance of FIGS. 4 and 5 may resemble prior art, this completed system of the preferred embodiment, as will be further described in the following Figures, will show the unique, yet significant differences that overcome the substantial deficiencies of prior art. It is obvious to anyone familiar with coffered ceilings that there may be any number of actual coffers, for example, four, nine, seventy and so on.

Figure 6:
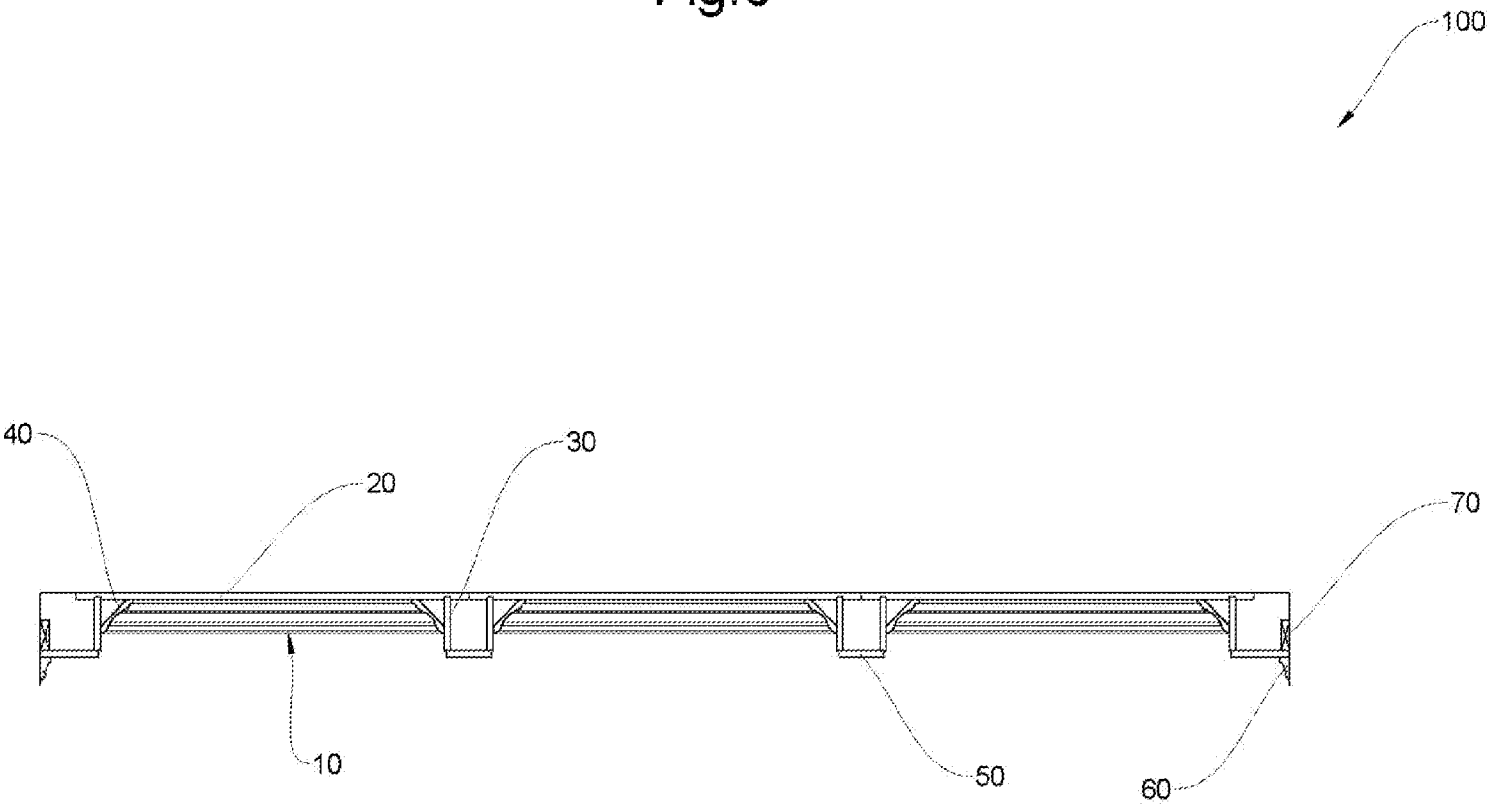
FIG. 6 is a cross-sectional view of the preferred embodiment illustrating a complete coffered ceiling system as it terminates into perpendicular walls/substrate surfaces.

In FIG. 6, the entire coffered system of the preferred embodiment 100 and its components consists of modules such as the preferred embodiment 10, a ceiling/surface panel 20, a beam wall board 30, a beam wall molding 40, and the addition of beam bottom board 50, a perimeter molding 60, and a nailer board/block 70. Likewise, while the appearance of FIG. 6 may resemble prior art, this completed system of the preferred embodiment will be further described in the following Figures and will show its unique, yet significant differences that overcome the deficiencies of prior art.

Figure 7:
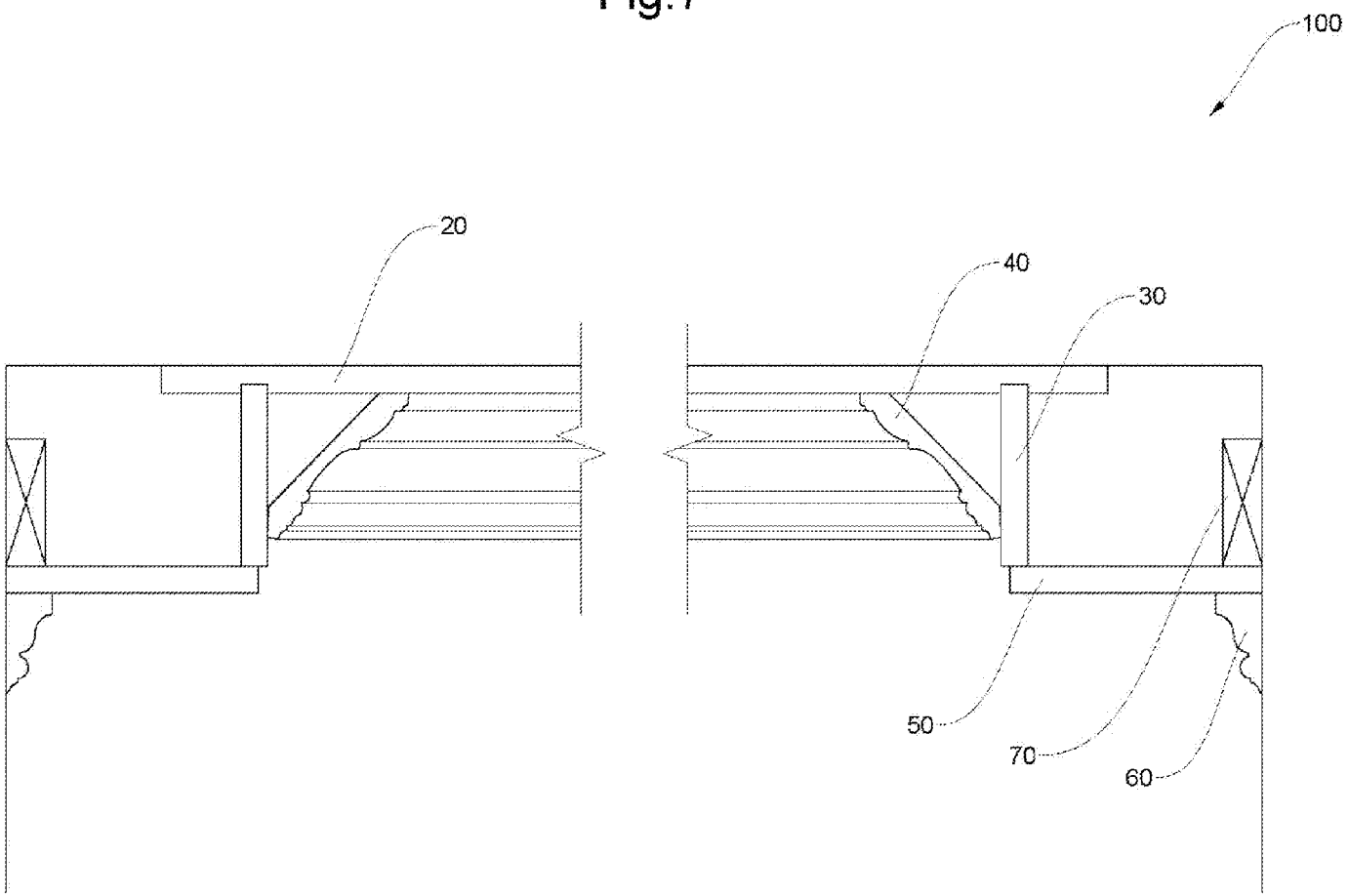
FIG. 7 is a blown-up cross-sectional view of the preferred embodiment illustrating the perimeter of a coffered ceiling system as it terminates into perpendicular walls/substrate surfaces.

In FIG. 7 the perimeter beam detail of the coffered system of the preferred embodiment 10 consists of a ceiling/surface panel 20, a beam wall board 30, a beam wall molding 40, a beam bottom board 50, a perimeter molding 60, and a nailer board/block 70. This is typically how the preferred embodiment will terminate at a perpendicular wall or surface. In certain circumstances, one or more of the perimeter beam bottom boards of the preferred embodiment may not terminate at a perpendicular wall or surface. For example, it may terminate into the substrate itself instead of into a surrounding perpendicular wall or surface. For example, the entire coffered system of the preferred embodiment 100 may only cover a centralized portion of the ceiling, or some other partial sector.

B. Method of Manufacture and Installation

Figure 8:
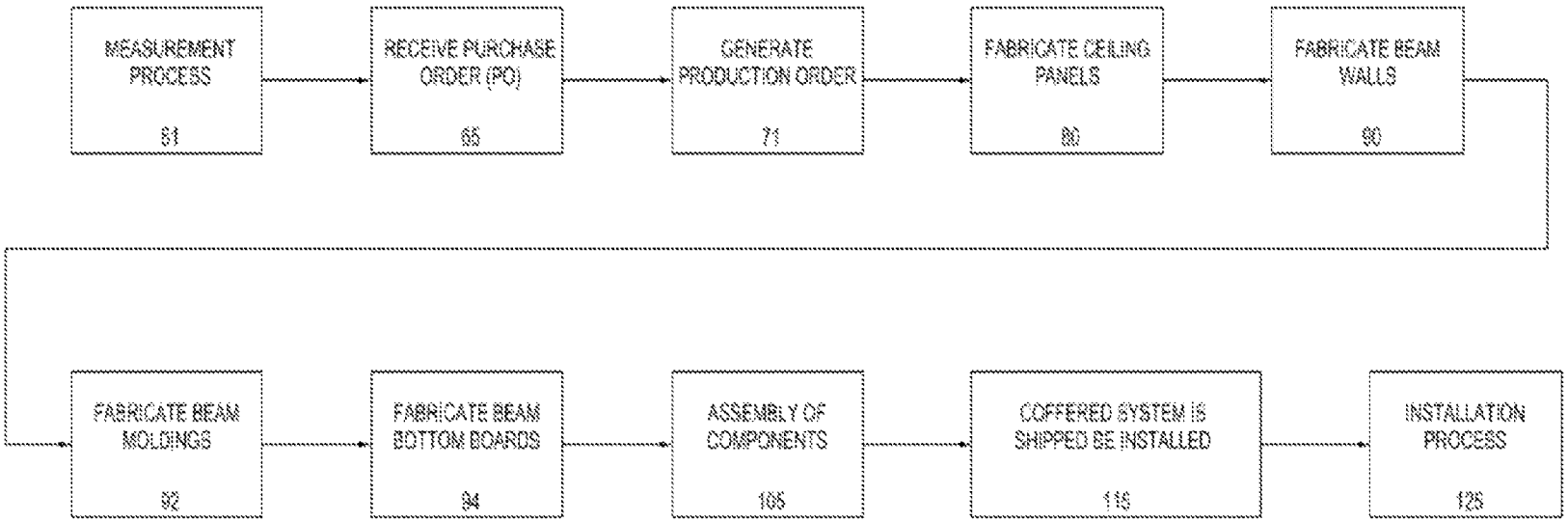
FIG. 8 is a block diagram of the manufacturing and installation processes of the preferred embodiment.

In FIG. 8 the preferred method of manufacture 51 begins with a typical user (may be a customer, installer, or otherwise) initiating the measurement process 61 by using an appropriate measuring device to determine the smallest or shortest dimension for both the length and width of the intended substrate. The measurement process helps to determine if the walls are or aren't straight, parallel and/or square. If measuring from a median or larger or the largest measurements would require trimming down and tapering the perimeter beam board. This is time consuming, difficult and aesthetically inferior.

The preferred embodiment overcomes the issues and problems associated with ceiling/surface areas that are out of square or irregular in their geometric shape and/or surrounding perpendicular walls/surfaces that are out of square to the ceiling/surface area or crooked, wavy or otherwise imperfect by allowing for the outermost edge of the perimeter beam bottom boards to be scribed or tapered as needed to make up the differences between the two. This allows for the coffer modules and all of the other coffered ceiling system components to remain perfectly square. Furthermore, the thickness and/or projection of the perimeter molding 61 aids in making up any final remaining differences between the outermost edge of the perimeter beam bottom boards and the surrounding perpendicular walls/surfaces and as a result relieves the installer of having to make exacting scribes or tapers on the perimeter beam bottom boards. In circumstances where the perimeter beam bottom boards do not terminate into a surrounding perpendicular wall or surface on one or more sides than no scribing or tapering is required and the coffered system components remain perfectly square regardless of the surrounding conditions.

With receipt of the dimensions from the user from the measurement process 61 a purchase order 65 is generated. Upon customer approval of the purchase order a production order 71 is generated and sent to an authorized manufacturing facility (AMF) for fabrication and assembly of the coffered ceiling system components. Next the AMF uses production order 71 to fabricate the ceiling/surface panels 80 which are completed accordingly. The ceiling/surface panels may include one or more processes for fabrication which may include preassembly. For example, with virtually endless custom design possibilities, various equipment, joinery, fasteners and so on may be used for the fabrication of the panels. Once fabrication 80 is complete the beam wall board fabrication process 90 begins where each beam wall board is cut to the specified length and width. The beam wall boards are preferably then prepped on each of the ends where they meet with one another for one of several types of joinery methods including, but not limited to a dado, a miter, a lock miter, dowels, screws, pocket hole screws and so on. These joinery types aid in aligning the beam wall boards to one another during the preassembly process as well as providing for a strong bond between the beam wall boards. Next, the beam wall molding fabrication process 92 cuts the beam wall moldings to the specified lengths preferably with a, butt, miter or cope joint on the ends where they meet. Typically, the order calls for an additional stage of fabrication wherein the beam bottom board process 94 cuts the beam bottom boards to the specified lengths and widths. Upon completion of steps 71 through 92, the components are ready for preassembly to form individual modules.

The fabrication of the beam bottom boards may also be done on site by purchasing material from a local supplier and fabricating them on site. Likewise the construction of the beam bottom boards as previously described may be accomplished by a myriad of tools, saws and so on and is not to be considered limited to those cited. While the material is typically some form of wood, it is conceivable it may include plastic or perhaps in some applications, a form or metal such as copper.

With the fabrication of the coffer module components completed, preassembly 105 begins by fastening the beam wall boards perpendicular to the face of the ceiling/surface panels using a joinery process that aids in proper placement of the beam wall boards. The beam wall boards are then fastened to the panels using one or a combination of several types of fasteners including, but not limited to nails, screws, biscuits, dowels and so on. Preassembly is completed by installing the beam board moldings one at a time in either clockwise or counter clockwise sequence inside of the completed ceiling panel and beam wall board assembly. Each piece of beam wall molding is fastened in place using glue or adhesive and nails, or any other form of concealable fastener.

The advantages of the preferred embodiment as described in FIG. 8 are substantial. For example, it may be preassembled by the AMF, which requires no onsite preassembly by the customer or end user. In this manner, the modules are shipped in a crate, box or otherwise and may be immediately fastened to the substrate when received. Alternatively, the modules may be offered in a "knocked-down" or unassembled disposition to reduce their overall size and packaging while also reducing shipping and manufacturing costs. In this instance, on-site preassembly of the coffered modules is required prior to fastening the modules to the substrate. This unique process 50 also provides innumerable design and material potentials, for example various woods, plastics, gold inlaid materials, metals and so on.

Upon completion of the various component fabrication processes the present invention is either preassembled or left in an unassembled disposition and is shipped to the end user to be installed 115 and is then installed 125 by a) locating and marking of center of both the length and width of the ceiling or surface area; b) locating and marking of the underlying framing joists or structural members of the ceiling or surface area for secure fastening of the coffer modules; c) installing the coffer modules using the specially designed shim screws; d) trimming the length and width of the perimeter beam bottom boards as needed and; e) trimming the length of and installing the intersecting beam bottom boards; f) trimming the length of and installing the perimeter moldings.

When the preferred embodiment is not preassembled prior to shipment, additional installation steps are required between 125 b) and 125 c) in the preceding paragraph. These may include: b1) Using a joinery process to properly align, set and fasten the beam wall boards perpendicular to the ceiling/ surface panels; b2) Installation of the beam board moldings with some form of concealable fasteners and/or adhesives in either a clockwise or counter clockwise sequence inside of the completed ceiling panel and beam wall board assemblies.

The manufacturing process as described does not necessarily need to include the installation process 125. Manufacturing the present invention primarily includes the processes 70 through 115. The installation process 125 is included herein to solely clarify the how the preferred embodiment may be installed, thus taking advantage of its unique qualities.

C. Business Method

Figure 9:
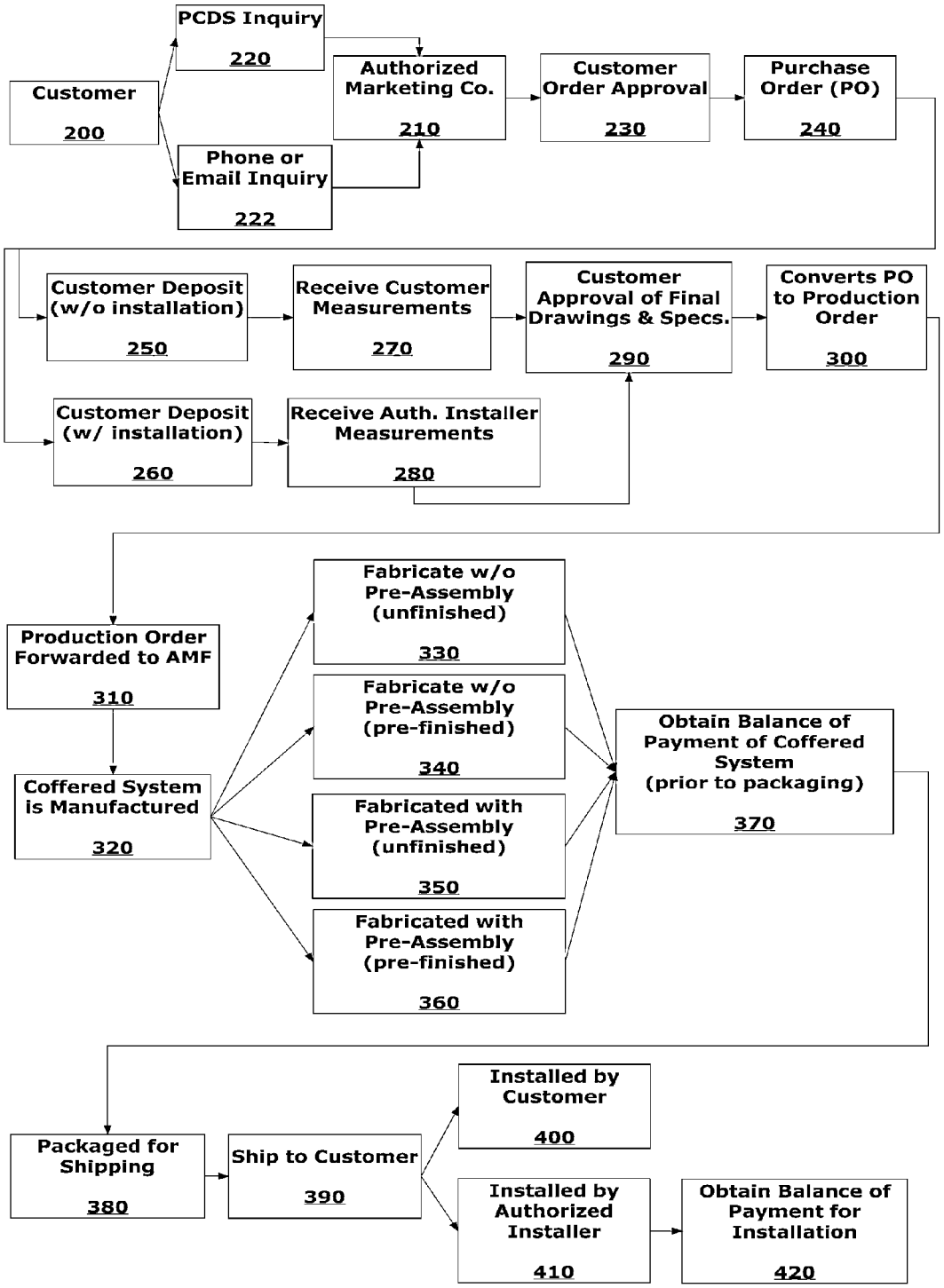
FIG. 9 is a flow chart showing the complete online business model/process of the preferred embodiment.

In FIG. 9 customer 200 provides ceiling or surface area dimensions, as well as desired layout and design specifications to an authorized sales/marketing (ASM) entity 210 via the unique parametric coffer design software (PCDS) 220 or by direct email, phone or fax for quotation purposes. A design drawing is either generated by the PCDS 220 or may be created by the ASM 210 using conventional methods. The PCDS enables customer 200, the ASM 210, or any other user, to determine a layout, view the design, and calculate an estimated cost based on the selected parameters and input. As the inputs to the PCDS are adjusted or changed by the user the cost estimate also changes accordingly. For the ASM, the PCDS provides a complete list of the quantity of materials needed to fabricate the specific coffered ceiling system and for the AMF it calculates a material cut list for all of the manufacturing processes as described in FIG. 9.

Upon confirmation of the overall design, specifications and cost 230 and acceptance by customer 200 a purchase order 240 is generated and sent to customer 200 for its final review and signature of approval. Customer 200 signs purchase order 240, returns it to the ASM, which may include a deposit for the system without installation service 250, or with installation service 260.

Upon receipt of the signed purchase order 240 and the order deposit 250 or 260, precise site measurements may be obtained by way of customer submittal 270 or authorized installer submittal 280. Once received the precise site measurements are used to produce final design drawing(s) 290. Final design drawing(s) 290 are then submitted to the customer 200 for signature of approval and returned to the ASM.

With the signed final design drawings received a production order 300 is generated and sent to an AMF 310. At the AMF 310 the coffered module components are manufactured 320 as required. The production order 300 may be either fabricated without preassembly and unfinished 330, without preassembly and prefinished 340, preassembled and unfinished 350, or preassembled and prefinished 360.

Upon completion of the fabrication process the balance of payment for the order 370 is obtained from the customer. Once the balance has been received the completed coffer system components and/or modules are packaged for shipment 380 to customer 200 and may be shipped by any conventional means 390. Upon receipt of the coffer system it may be completed by way of customer installation 400, or by authorized installer 410. The installation 400 or 410 typically includes fastening of the coffer modules to the substrate and then finishing them with the installation of the beam bottom boards and the perimeter molding. If the installation is performed by an authorized installer 410 then the balance of payment for the installation 420 is collected on completion.

The business model and methodology described may also include other variables such as the elimination of a deposit, whereas payments are made after installation has been completed. It may also include a model where payment is made in whole upon, or perhaps even after the actual installation. The intention of this business model is not to provide a business model, which is typical in this day and with current contracting methodologies. However, it is also the intention to provide a broader model that may be adaptable to other forms of billing methods that may evolve in the future.

The business model of the present invention may also include a method whereas the ASM, the PCDS, and the AMF, are one and the same entity. While it may be interpreted as a single entity, it nevertheless functions in concert with the present invention herein as each on of the components, the ASM, PCDS, and the AMF, function as an independent department within the entity.

E. Variations

The spirit of the present invention provides a breadth of scope that includes all methods of making and using it. Any variation on the theme and methodology of accomplishing the same that are not described herein would be considered under the scope of the present invention.

What is claimed is:

1. A coffer module, comprising:

a panel;

beam wall boards attached perpendicular to a first side of the panel and extending away from the panel and forming side walls for intersecting, non-structural hollow box beams, wherein the panel extends past the beam wall boards to create a fastening flange or point by which one or more modules are secured to a substrate; and one or more beam wall moldings cut to size and custom-fitted to the beam wall boards and the panel after the beam wall boards have been attached to the panel, wherein the one or more beam wall moldings connects surfaces between the beam wall boards and the panel and wherein the panel directly terminates into the substrate and wherein the beam wall moldings follow a shape of the beam wall boards.

2. The module of claim 1, wherein the one or more beam wall moldings connects the beam wall board and panel surfaces and provide structural support and reinforcement of the beam wall board and the module.

3. The module of claim 1, comprising a nailer board or block to terminate perimeter beam bottom boards and moldings to adjacent perpendicular walls or surfaces.

4. The module of claim 1, wherein the panel, beam wall boards, and beam wall moldings are custom-fitted to a given surface area.

5. The module of claim 1, wherein the panel, beam wall boards, and beam wall moldings are preassembled to form individual modules.

6. The module of claim 1, wherein the panel is selected from a group of styles consisting of: applied moldings, recessed/flat panel, raised panel and bead board panel.

7. The module of claim 1, comprising a joinery process that aligns and attaches the beam wall boards to the panel during preassembly.

8. The module of claim 1, wherein the modules are completed by installing beam wall molding pieces one at a time in either clockwise or counter clockwise sequence inside of a completed panel and beam wall board assembly.

9. The module of claim 1, wherein a location of the coffer beam wall boards against the panel creates a flange that remains around a perimeter of the coffer module for fastening and spacing of the modules during on-site installation.

10. The module of claim 9, wherein coffered module components are fabricated with computer readable code for computer controlled fabrication equipment with user selectable options including: without preassembly and unfinished, without preassembly and prefinished, preassembled and unfinished, or preassembled and prefinished.

11. A system, comprising:

a plurality of coffer modules, each with a coffer panel, coffer beam wall boards attached perpendicular to a first side of the panel and extending away from the panel and forming the side walls for intersecting, non-structural hollow box beams, and coffer beam wall moldings, wherein each module includes a beam wall molding that connects the surfaces between the coffer beam wall boards and the coffer panel and wherein one or more of the panels directly terminates into the substrate and wherein the beam wall molding follows a shape formed by the beam wall boards;

beam bottom boards positioned between the coffer modules to complete a plurality of hollow box beams in an intersecting grid to replicate a desired look and feel of structural elements, wherein the panel extends past the beam wall boards to create a fastening flange or point by which one or more of the modules are secured to a substrate; and perimeter moldings positioned between outer perimeter beam bottom boards and adjacent perpendicular walls or surfaces.

12. The system of claim 11, comprising a nailer board or block to terminate the perimeter beam bottom boards and perimeter moldings into the adjacent perpendicular walls or surfaces.

13. The system of claim 11, wherein the panel, beam wall boards, and beam wall moldings are custom-fitted to a given surface area.

14. The system of claim 11, wherein the panel, beam wall boards, and beam wall moldings are preassembled to form individual modules.

15. The system of claim 11, wherein the panel is selected from a group of styles including smooth panel, applied molding panel, recessed/flat panel, raised panel or bead board panel.

* * * * *